US009888738B2

(12) United States Patent
Law

(10) Patent No.: US 9,888,738 B2
(45) Date of Patent: Feb. 13, 2018

(54) SLIPPER BODY AND SLIPPER WITH AN ORNAMENT

(75) Inventor: Yuen Mou Law, Hong Kong (HK)

(73) Assignee: Magic Land Limited, Hong Kong (HK)

( * ) Notice: Subject to any disclaimer, the term of this patent is extended or adjusted under 35 U.S.C. 154(b) by 580 days.

(21) Appl. No.: 12/958,103

(22) Filed: Dec. 1, 2010

(65) Prior Publication Data

US 2012/0137539 A1 Jun. 7, 2012

(51) Int. Cl.

| | |
|---|---|
| ***A43B 23/00*** | (2006.01) |
| ***A43B 3/10*** | (2006.01) |
| ***A43B 3/12*** | (2006.01) |
| ***A43B 3/00*** | (2006.01) |
| ***A43B 23/25*** | (2006.01) |

(52) U.S. Cl.
CPC ..... *A43B 3/105* (2013.01); *A43B 3/0078* (2013.01); *A43B 3/12* (2013.01); *A43B 23/25* (2013.01)

(58) Field of Classification Search
CPC ..... A43B 3/105; A43B 3/103; A43B 3/101; A43B 3/122; A43B 3/126; A43B 23/25; A43B 23/24
USPC ..... 36/11.5, 136, 132, 114
See application file for complete search history.

(56) References Cited

U.S. PATENT DOCUMENTS 4,864,736 A * 9/1989 Bierk ..... A43B 3/106 2/245
5,052,131 A * 10/1991 Rondini ..... A43B 1/0072 36/11.5
6,442,862 B1 * 9/2002 Kimura et al. ..... 33/732
6,769,204 B1 * 8/2004 Phillips ..... A43B 1/0081 36/100
7,152,286 B2 * 12/2006 Rooney et al. ..... 24/712.6
7,200,959 B2 * 4/2007 Spann ..... 36/136
2005/0274039 A1 * 12/2005 Lee ..... B29D 35/146 36/11.5
2006/0007668 A1 * 1/2006 Chien ..... 362/103
2006/0010721 A1 * 1/2006 Valko ..... 36/136
2007/0089322 A1 * 4/2007 Rooney et al. ..... 36/136
2009/0007459 A1 * 1/2009 Barnett ..... 36/136
2009/0038181 A1 * 2/2009 Loughnane ..... A43B 3/24 36/94
2010/0011623 A1 * 1/2010 Seckler ..... A43B 1/0054 36/136
2012/0192331 A1 * 8/2012 Fowler ..... A45C 13/001 2/12

(Continued)

*Primary Examiner* — Jila M Mohandesi

(57) ABSTRACT

The present invention relates to a slipper body with a sole (1) and a vamp (2), wherein the vamp (2) is ribbon shape and has an inner surface (22) being capable to contact with the instep and a decorative surface (21) opposite to the inner surface (22). A fixing slot (23) is arranged between the inner surface (22) and the decorative surface (21) on the vamp (2) for fixing an ornament. The present invention further relates to a slipper with an ornament, which comprises a slipper body above-mentioned and an ornament (3) fixed onto the vamp (2) by the fixing slot (23). With the slipper body and the slipper with an ornament according to the present invention, the consumers can select or change the ornaments of the vamp on their own to meet the personal requirements without the wearing comfortability being affected, and the ornaments can be removed without influencing the beautiful degree of the vamp. In addition, the slipper body and the slipper have simple structures and are easy to use.

1 Claim, 2 Drawing Sheets

(56) References Cited

U.S. PATENT DOCUMENTS

| | | | | |
|---|---|---|---|---|
| 2012/0234042 | A1* | 9/2012 | Chase et al. | 63/1.18 |
| 2013/0091620 | A1* | 4/2013 | Randolph | A41D 27/08 2/244 |

* cited by examiner

SLIPPER BODY AND SLIPPER WITH AN ORNAMENT

FIELD OF THE INVENTION

The present invention relates to the field of shoes, more specifically to a slipper body and slipper with an ornament.

BACKGROUND OF THE INVENTION

Generally, the patterns or designs are printed or attached onto the vamp by other manners, or various ornaments are directly fastened onto the vamp in order to decorate the vamp with respect to the slippers in the prior art. On the one hand, the personal requirements of the consumers can hardly be met due to the existing ornaments fixed by these methods when shopping. On the other hand, the ornaments of the vamp can not be replaced by other patterns, designs or ornaments after shopping. In addition, the various ornaments with clamps can be gripped by the consumers, but it will seriously affect the wearing comfortability because the clamps occupy the inner space of the slippers.

SUMMARY OF THE INVENTION

The objective of the present invention is therefore to provide a slipper, which enables the consumers select the ornaments of the vamp on their own and change for other ornaments conveniently, so as to meet the personal requirements of the consumers and not to affect the wearing comfortability, and of which the beautiful degree of the vamp will not be affected after removing the ornament. The slipper also has simple structure and is easy to use.

According to one aspect, a slipper body with a sole and a vamp is provided, wherein the vamp is ribbon shape and has an inner surface being capable to contact with the instep and a decorative surface opposite to the inner surface. In addition, a fixing slot is arranged between the inner surface and the decorative surface on the vamp for fixing an ornament.

Preferably, the fixing slot extends through the vamp.

It's also preferable that at least two fixing slots are provided.

According to another aspect, a slipper with an ornament is provided, which comprises a slipper body as mentioned above and an ornament fixed onto the vamp by the fixing slot.

In an advantageous embodiment, the ornament has an ornament body and a sheet-shaped fixing plate connected with the ornament body, and is fixed onto the vamp by the mating between the fixing plate and the fixing slot.

In a further advantageous embodiment, the rear end of the fixing plate is hinged with the rear part of the back side of the ornament body.

In a further advantageous embodiment, the front end of the fixing plate bends towards one side thereof.

The following beneficial effects can be obtained with implementing the slipper according to the present invention. A simple fixing slot for fixing an ornament is arranged on the vamp and can be easily inserted into various ornaments for change, which enlarges the range of ornaments to be selected by the consumers and thus meets the personal requirements of the consumers. Since the fixing slot is situated between the inner surface and the decorative surface, the opening thereof will not influence the inner surface and the decorative surface. Not only is the wearing comfortability of the consumers not influenced after fixing an ornament, but also the beautiful degree of the vamp is not affected after removing the ornament. The fixing plate is sheet-shaped, which is inserted into the fixing slot without making the inner surface project towards the inner side to lower the wearing comfortability. In addition, the front end of the fixing plate bends towards one side thereof, which makes the front end of the fixing slot blocked at the opening of the fixing slot and thus the fixing plate not easy to escape out of the fixing slot.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, and wherein.

DETAILED DESCRIPTION OF THE PREFERRED EMBODIMENT

Figure 1:
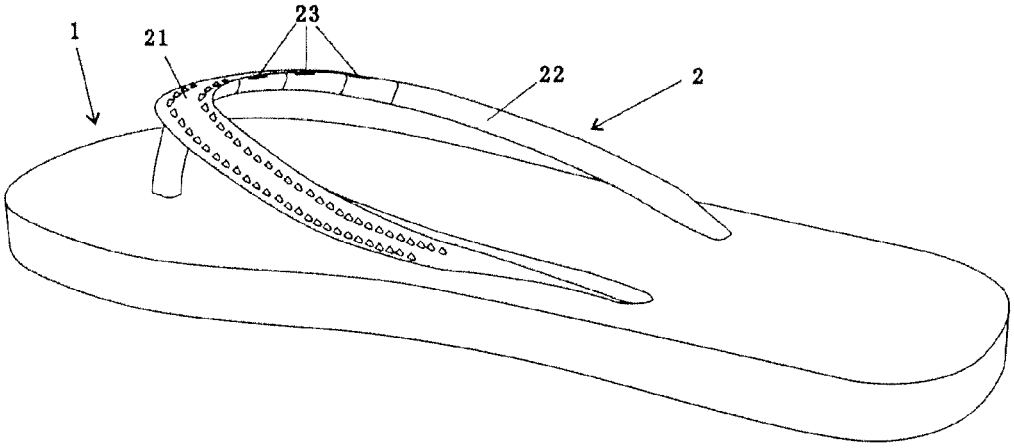
FIG. 1 is the structural view of the slipper body in a preferred embodiment according to the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. The use of examples anywhere in this specification, including examples of any terms discussed herein, is illustrative only, and in no way limits the scope and meaning of the invention or of any exemplified term. Likewise, the invention is not limited to various embodiments given in this specification.

As used herein, the terms "comprising," "including," "having," "containing," "involving," and the like are to be understood to be open-ended, i.e., to mean including but not limited to.

Figure 2:
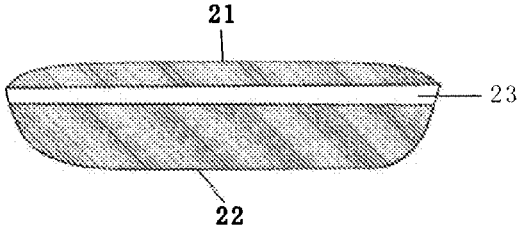
FIG. 2 is the cross-sectional view of the vamp of the slipper body in a preferred embodiment according to the present invention.

In a preferred embodiment as shown in FIG. 1, the slipper body according to the present invention includes a sole 1 and a vamp 2, wherein the vamp 2 has an inner surface 22 contacting with the instep and a decorative surface 21 opposite to the inner surface 22 outside. A fixing slot 23 for fixing an ornament is arranged between the inner surface 22 and the decorative surface 21 on the vamp 2. As shown in FIG. 2, the fixing slot 23 contained between the inner surface 22 and the decorative surface 21 extends through the vamp 2. There are three fixing slots 23 on the vamp 2 in FIG. 1, which can be used to fix 1 to 3 ornaments.

Since the fixing slot 23 is situated between the inner surface 22 and the decorative surface 21, the opening of the fixing slot 23 will not influence the inner surface 22 and the decorative surface 21. In the case of only fixing 1 or 2 ornaments or without ornaments fixed, neither the beautiful degree of the vamp 2 nor the wearing comfortability of the consumers is affected.

Figure 3:
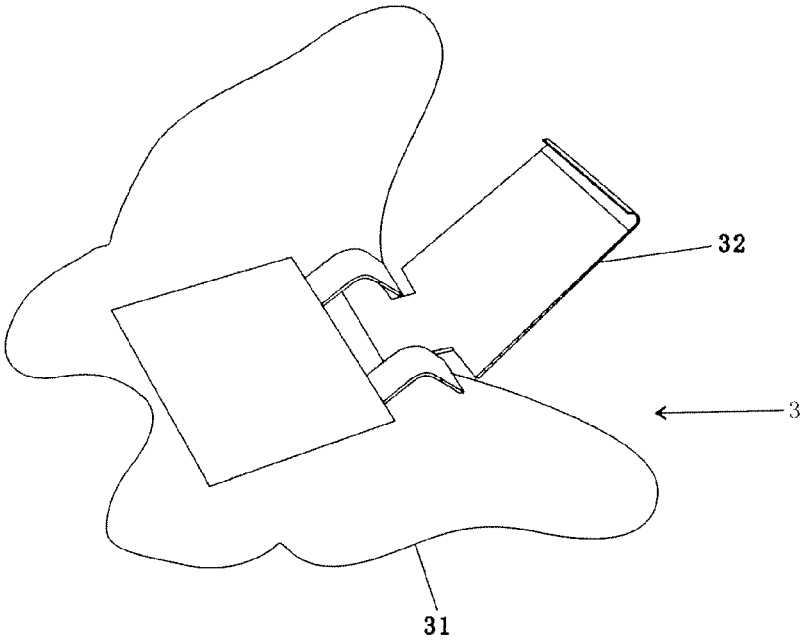
FIG. 3 is the view of the ornament in an opening condition in a preferred embodiment according to the present invention.

In a preferred embodiment, the slipper according to the present invention comprises the above-mentioned slipper body and an ornament 3, which is fixed on the vamp 2 by way of the fixing slot 23. As shown in FIG. 3, the ornament 3 includes an ornament body 31 and a fixing plate 32 for inserting into the fixing slot 23. The fixing plate 32 connects with the ornament body 31, more specifically, the rear end of the fixing plate 32 is hinged onto the rear part of the back side of the ornament body 31. The ornament 3 is fixed onto the vamp 2 through the mating of the fixing plate 32 and the fixing slot 23.

Figure 4:
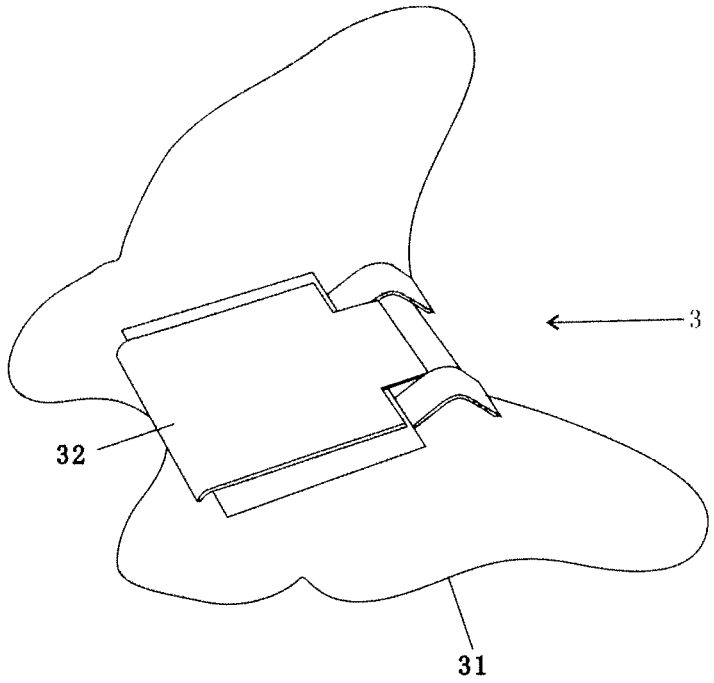
FIG. 4 is the view of the ornament in a closing condition in a preferred embodiment according to the present invention.
Figure 5:
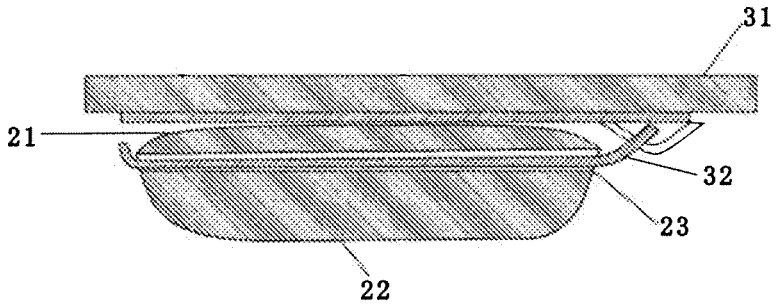
FIG. 5 is the cross-sectional view of the vamp with the ornament fixed in a preferred embodiment according to the present invention.

The rear end of the fixing plate 32 is hingably connected with the rear part of the back side of the ornament body 31, which enables the fixing plate 32 and the ornament body 31 rotate about the hinge connection relatively to one another. Through rotation, the front end of the fixing plate 32 can be displaced near to the front end of the ornament body 32. In this way, the fixing plate 23 in its entirety is placed at the back side of the ornament body 32 and thus there are two conditions with the fixing plate 32 and the ornament body 31, which two conditions are the opening and closing conditions as respectively shown in FIGS. 3 and 4. In the opening condition, the fixing plate 32 can be inserted into the fixing slot 23 so as to close the ornament body 31 towards the fixing plate 32. Because of the hinge connection between the rear end of the fixing plate 32 and the rear part of the back side of the ornament body 31, the back side of the ornament body 31 can be abutted against the decorative surface 21 of the vamp 2 to situate and grip the ornament body 31 onto the vamp 2 after closing the ornament body 31 by rotating. The fixing plate 32 is sheet-shaped and thus will not make the inner surface 22 project towards the inner side while being inserted into the fixing slot 23. Consequently, the wearing comfortability is not influenced. As shown in FIGS. 3 to 5, the front end of the fixing plate 32 bends towards one side thereof, so as to block the front end of the fixing plate 32 above the opening of the fixing slot 23. Therefore, the fixing plate 32 can not easily escape out of the fixing slot 23.

In a preferred embodiment, a fixing slot 23 is provided on the vamp 2 to form a simple structure. Various ornaments 3 for change can conveniently be inserted into the fixing slot 23, in order to enlarge the range of ornaments 3 to be selected by the consumers and meet the personal requirements of the consumers. Since the fixing slot 23 is situated between the inner surface 22 and the decorative surface 21, the opening thereof will not influence the inner surface 22 and the decorative surface 21. Not only is the wearing comfortability of the consumers not influenced after fixing the ornament 3, but also the beautiful degree of the vamp 2 is not affected after removing the ornament 3. The ornament 3 is fixed onto the vamp 2 by the mating of the fixing plate 32 and the fixing slot 23, and the fixing plate 32 is sheet-shaped, which is inserted into the fixing slot 23 without lowering the wearing comfortability. In addition, the front end of the fixing plate 32 bends towards one side thereof, in order to block the front end of the fixing plate 32 above the opening of the fixing slot 23, which makes the fixing plate 32 not easy to escape out of the fixing slot 23.

In a preferred embodiment, it is preferable that three fixing slots are provided on the vamp so as to insert 1 to 3 ornaments simultaneously. It is understood that the number of the fixing slots is not restricted to this. For example, one or two fixing slots or fixing slots with any other number can be provided on the vamp.

In addition, it is also understood that the front end of the fixing plate can bend towards the side thereof opposite the side as shown in the FIGS. 3 to 5. In this way, the front end of the fixing plate 32 is blocked below the opening of the fixing slot 23.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A slipper body comprising a sole (1) and a vamp (2), wherein the vamp (2) comprises of a band of material having side surfaces that separate an inner surface (22) capable of contacting an instep of the foot and a decorative surface (21) opposite to the inner surface (22), a plurality of fixing slots (23) arranged between the inner surface (22) and the decorative surface (21) on the vamp (2) for receiving a plurality of ornaments (3) respectively, wherein each of the fixing slots (23) is defined by opposite openings that are located on the side surfaces of the vamp, and a longitudinal axis that extends between the opposite openings of each of the fixing slots (23), the longitudinal axis being parallel to the inner surface (22) and the decorative surface (21), and wherein each of the fixing slots (23) extends through a width of the vamp (2) between the inner surface (22) and the decorative surface (21);

wherein said slipper body further comprises a plurality of ornaments (3) which are fixed onto the vamp (2) by the plurality of the fixing slots (23), and each ornament (3) has an ornament body (31) and a fixing plate (32) hingedly connected to the ornament body (31), each ornament is fixed onto the vamp (2) by the mating between the fixing plate (32) and a corresponding fixing slot (23);

wherein a rear end of the fixing plate (32) is hinged to a rear part of a back side of the ornament body (31), wherein the fixing plate (32) and the ornament body (31) rotate relatively to one another about the hinge, wherein a front end of the fixing plate (32) is displaced near a front end of the ornament body (32) and the fixing plate (32) completely covers the back side of the ornament body, wherein there are two conditions between the fixing plate (32) and the ornament body (31), an opening condition and a closing condition; wherein during the opening condition, the fixing plate (32) is inserted into the fixing slot (23) to close the ornament body (31) towards the fixing plate (32); and during the closing condition, a back side of the ornament body (31) is abutted against the decorative surface (21) of the vamp (2) to situate and grip the ornament body (31) onto the vamp (2) after rotatably closing the ornament body (31); wherein the front end of the fixing plate (32) curves towards one side of the fixing plate (32) to block the front end of the fixing plate (32) above the opening of the fixing slot (23) and fix the fixing plate (32) in the fixing slot (23).

* * * * *